US006840436B2

(12) United States Patent
Wang

(10) Patent No.: US 6,840,436 B2
(45) Date of Patent: Jan. 11, 2005

(54) FOLDING COLLAPSIBLE BOX

(76) Inventor: Wen-Tsan Wang, PO Box 82-144, Taipei (TW)

( * ) Notice: Subject to any disclaimer, the term of this patent is extended or adjusted under 35 U.S.C. 154(b) by 57 days.

(21) Appl. No.: 10/445,874

(22) Filed: May 28, 2003

(65) Prior Publication Data

US 2004/0238610 A1 Dec. 2, 2004

(51) Int. Cl.[7] ..... B65D 5/36

(52) U.S. Cl. ..... 229/117.04; 229/117.22; 229/117.19; 229/117.09; 383/14

(58) Field of Search ..... 229/117.05, 117.04, 229/117.09, 117.18, 117.19, 117.22, 117.25, 117.26; 383/13, 14

(56) References Cited

U.S. PATENT DOCUMENTS 858,278 A * 6/1907 Gilman ..... 229/117.03
2,181,208 A * 11/1939 Satz ..... 190/115
2,274,536 A * 2/1942 Doppelt ..... 190/115
2,518,818 A * 8/1950 Ringler ..... 229/117.06
2,609,137 A * 9/1952 Toensmeier ..... 206/166
4,191,232 A * 3/1980 Szabo ..... 383/20
5,320,279 A * 6/1994 Giblin et al. ..... 229/225

* cited by examiner

*Primary Examiner*—Tri M. Mai
(74) *Attorney, Agent, or Firm*—Leong C. Lei

(57) ABSTRACT

A folding collapsible box is constructed to include a box body, the box body having two cardboard reinforced upright sidewalls symmetrically disposed at two sides, each cardboard reinforced upright sidewall having a vertical folding line on the middle, and two locating members respectively detachably coupled to the cardboard reinforced upright sidewalls through a slip joint to hold the cardboard reinforced upright sidewalls in shape and vertically movable relative to the box body between a received position and an extended position.

4 Claims, 6 Drawing Sheets

FOLDING COLLAPSIBLE BOX

BACKGROUND OF THE INVENTION

1. Field of the Invention

The present invention relates to boxes and, more particularly, to a folding collapsible box that can be collapsed after removal of the locating members from the box body.

2. Description of the Related Art

A folding collapsible box is known comprising a rectangular box body made from flexible fabric material, four horizontal top rods respectively fastened to the box body at the top, two horizontal bottom rods bilaterally fastened to the box body at the bottom, and four upright rods respectively vertically fastened to the four angles of the box body and spaced from the ends of the horizontal top rods and the ends of the horizontal bottom rods at a distance. The four peripheral panels of the box body each have a diagonally crossed folding line. The horizontal top and bottom rods and the upright rods support the box body in shape for keeping things. By means of twisting the box body, the folding collapsible box is collapsed. This structure of folding collapsible box is complicated, resulting in high manufacturing cost. Further, conventional folding collapsible boxes are not suitable for use as drawers in a cabinet if equipped with carrying handles.

SUMMARY OF THE INVENTION

The present invention has been accomplished under the circumstances in view. It is therefore one object of the present invention to provide a folding collapsible box, which is simple and inexpensive to manufacture. It is another object of the present invention to provide a folding collapsible box, which is equipped with receivable carrying handles. It is still another object of the present invention to provide a folding collapsible box, which can be used in a cabinet as a drawer.

To achieve these and other objects and according to one aspect of the present invention, the folding collapsible box comprises a box body, the box body having two cardboard reinforced upright sidewalls symmetrically disposed at two sides, each cardboard reinforced upright sidewall having a vertical folding line on the middle, two locating members respectively detachably coupled to the cardboard reinforced upright sidewalls to hold the cardboard reinforced upright sidewalls in shape.

According to another aspect of the present invention, socket members and stud members are used to fasten the locating members to the cardboard reinforced upright sidewalls of the box body, enabling the locating members to be moved vertically relative to the box body between a received position where the folding collapsible box can be used in a cabinet as a drawer, and an extended position where the locating members are used as carrying handles for the folding collapsible box.

DETAILED DESCRIPTION OF THE PREFERRED EMBODIMENT

Figure 1:
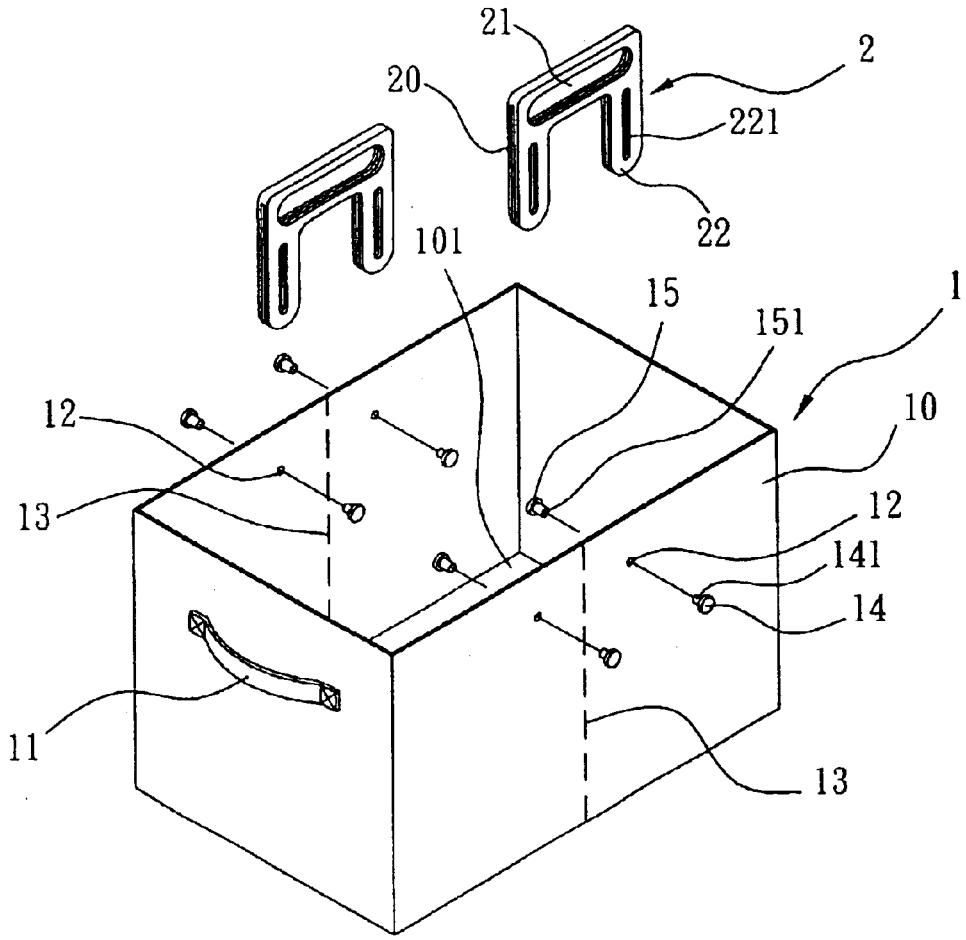
FIG. 1 is an exploded view of a folding collapsible box according to the present invention.
Figure 4:
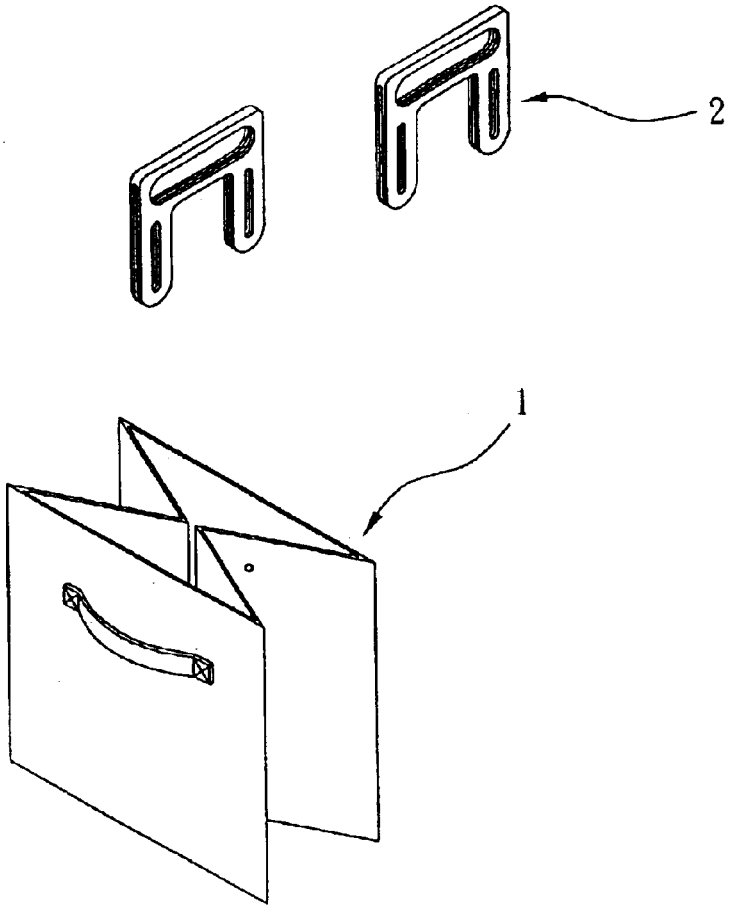
FIG. 4 shows the locating members detached from the box body and the box body collapsed according to the present invention.
Figure 5:
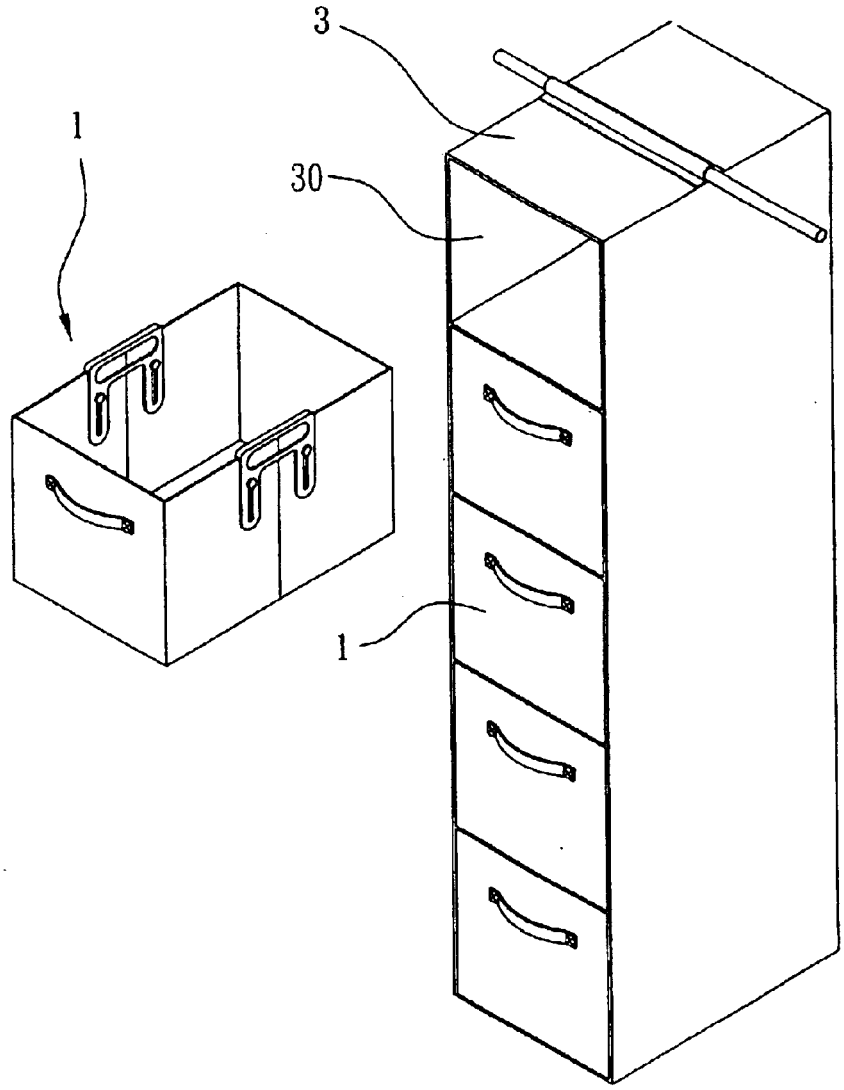
FIG. 5 shows the folding collapsible box used in a hanging cabinet according to the present invention.
Figure 6:
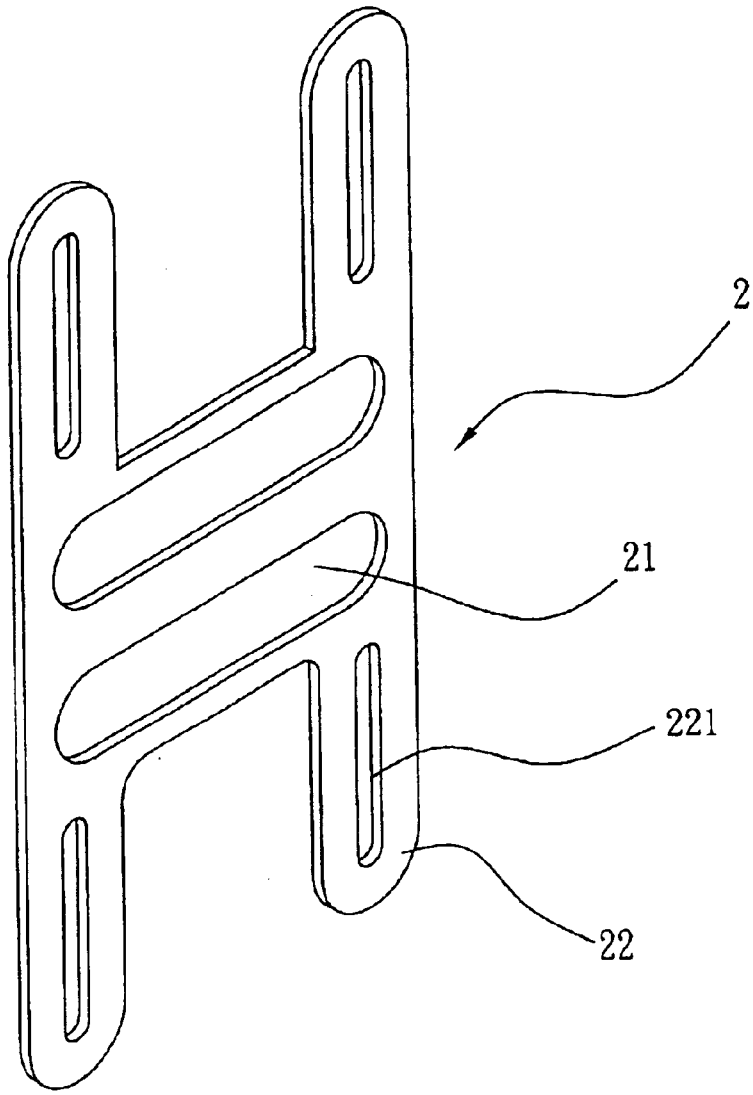
FIG. 6 is an extended out view of one locating member according to the present invention.

Referring to FIG. 1, a folding collapsible box in accordance with the present invention is shown comprised of a folding collapsible box body 1 and two locating members 2. The box body 1 is a hollow rectangular top-open container having a bottom wall 101 and four upright sidewalls 10 around the four sides of the bottom wall 101. The bottom wall 101 is made of soft fabric. The upright sidewalls 10 are respectively made of soft fabric with at least one cardboard respectively embedded therein. Two opposite upright sidewalls 10 of the box body 1 have a respective vertical folding line 13 on the middle through which the upright sidewalls 10 can be folded up (see FIG. 4). One of the other two upright sidewalls 10 is equipped with a handle 11.

The locating members 2 are hard members of substantially π-shaped cross section, each having a hand hole 21 transversely disposed at the top and two symmetrical pairs of extension arms 22 bilaterally downwardly suspended below the hand hole 21. The two symmetrical pairs of extension arms 22 define a downwardly extended clamping gap 20 approximately equal to the wall thickness of the upright sidewalls 10 that have a respective vertical folding line 13 on the middle. Each extension arm 22 has a longitudinal sliding slot 221. The upright sidewalls 10 that have a respective vertical folding line 13 on the middle each have two through holes 12 equally spaced from the respective vertical folding line 13 at two sides.

Figure 2:
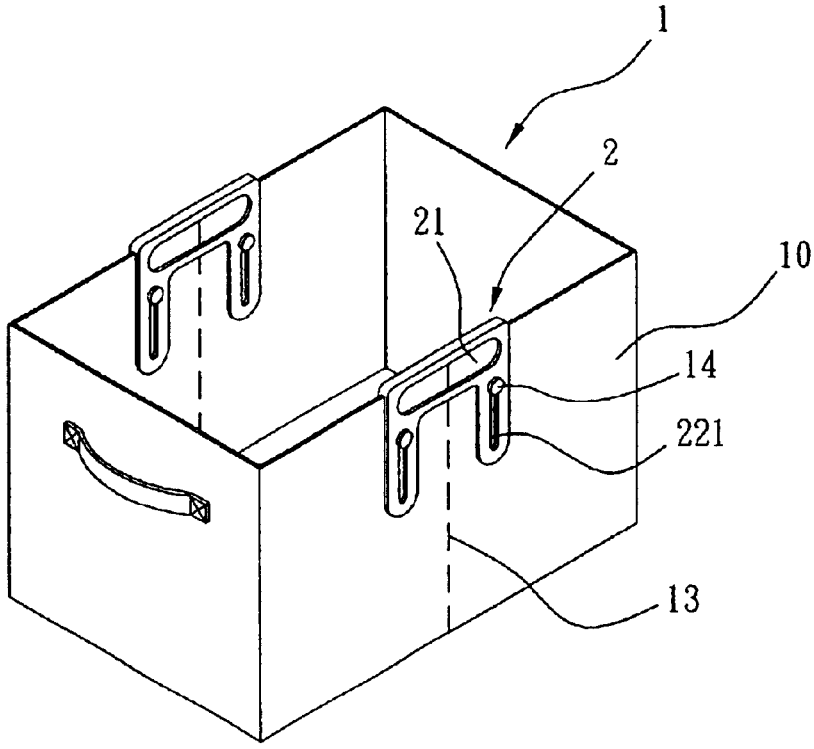
FIG. 2 is an assembly view of the folding collapsible box according to the present invention.
Figure 3:
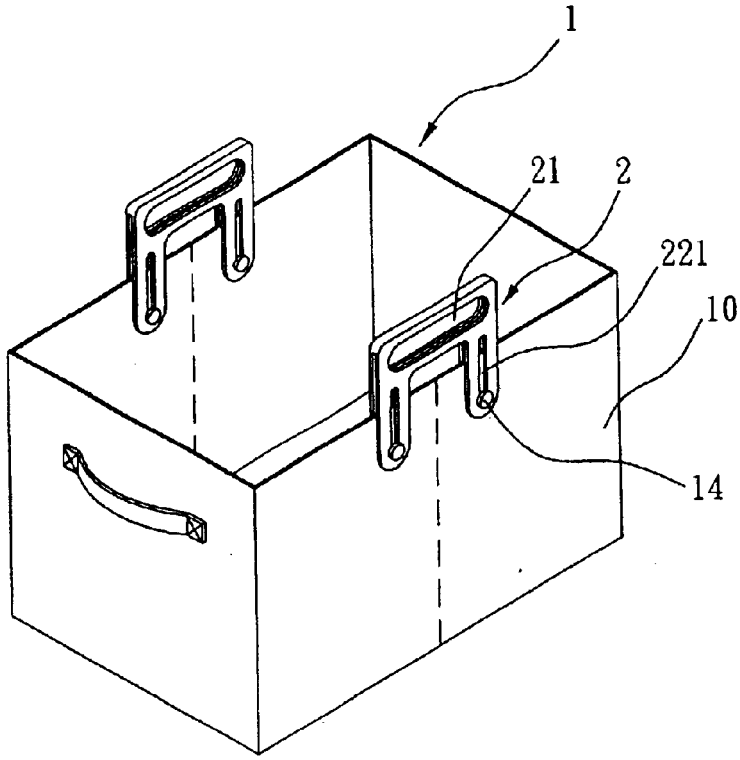
FIG. 3 is similar to FIG. 2 but showing the locating members lifted and used as handles.

By means of the downwardly extended clamping gap 20 between the two symmetrical pairs of extension arms 22 of each locating member 2, the locating members 2 are respectively attached to the two upright sidewalls 10 that have a respective vertical folding line 13 on the middle, and then male and female fastening elements 14 and 15 are installed in the through holes 12 and the sliding slots 221 of the extension arms 22 to secure the locating members 2 to the box body 1. The male and female fastening elements 14 and 15 are stud members 14 and socket members 15. The shanks 141 of the stud members 14 are respectively inserted through the longitudinal sliding slots 221 of the extension arms 22 of the locating members 2 and the through holes 12 of the respective upright sidewalls 10 of the box body 1, and then respectively press-fitted into the socket holes 151 of the socket members 15 to secure the locating members 2 to the respective upright sidewalls 10 of the box body 1, enabling the locating members 2 to be moved vertically within a limited distance between the first position where the transverse hand holes 21 of the locating members 2 are blocked by the respective upright sidewalls 10 of the box body 1 as shown in FIG. 2, and a second position where the transverse hand holes 21 of the locating members 2 are suspended above the topmost edge of the box body 1 for the insertion of the hands as shown in FIG. 3. When the locating members 2 moved to the second position, they are used as carrying handles. Further, when the locating members 2 fastened to the box body 10, they hold the respective upright sidewalls 10 of the box body 1 in shape (either when moved to the first position or the second position), and the box body 1 is set in the operative condition for keeping thinks.

The folding collapsible box can be used independently as individual container for keeping things. It can also be used as a drawer movable in and out of a drawer space 30 in a hanging cabinet 3.

The locating members 2 can be directly injection-molded from plastics. Alternatively, the locating members 2 can be respectively made from a metal plate by stamping and then folded into shape. FIG. 1 shows a stamped plate for the locating member before folding into shape. As illustrated, the extended status of the stamped plate has two symmetrical halves integral with each other, each symmetrical half having a transverse hand hole 21 and two extension arms 22, each extension arm 22 having a longitudinal sliding slot 221.

A prototype of folding collapsible box has been constructed with the features of FIGS. 1~6. The folding collapsible box functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A folding collapsible box comprising:

a box body, said box body having a rectangular flexible bottom wall, two first hard upright sidewalls and two second hard upright sidewalls perpendicularly upwardly extended from the four sides of said rectangular flexible bottom wall, and a top open side, said first hard upright sidewalls each having a vertical folding line on the middle and a plurality of through holes symmetrically spaced from said vertical folding line at two sides;

two locating members respectively attached to said first hard upright sidewalls of said box body to support said first hard upright sidewalls in shape, said locating members each comprising a clamping gap, which receives one of said first hard upright sidewalls, and two symmetrical pairs of downwardly extended extension arms respectively attached to the corresponding first hard upright sidewall at two sides, said extension arms each having a longitudinal sliding slot; and fastening devices respectively mounted in the longitudinal sliding slots of said extension arms of said locating members and the through holes of said first hard upright sidewalls of said box body to secure said locating members to said first hard upright sidewalls, enabling said locating members to be moved vertically relative to said first hard upright sidewalls within a limited distance equal to the length of the sliding slots of said extension arms.

2. The folding collapsible box as claimed in claim 1, wherein said locating members are respectively formed of a plate member having two integrated symmetrical halves, said plate member having two integrated symmetrical halves being bent into shape to form one locating member.

3. The folding collapsible box as claimed in claim 1, wherein said fastening devices are snaps, each comprising a stud member and a socket member adapted to receive said stub member.

4. The folding collapsible box as claimed in claim 1, wherein said two first hard upright sidewalls are respectively formed of a fabric covering and two cardboards embedded in said fabric covering and defining in therebetween the vertical folding line of the respective first hard upright sidewall.

* * * * *